US006402541B1

(12) United States Patent
Mindeau

(10) Patent No.: US 6,402,541 B1
(45) Date of Patent: Jun. 11, 2002

(54) ELECTRIC CONNECTOR USING ELEMENTS PENETRATING THE INSULATION

(75) Inventor: Patrick Mindeau, Morlon (CH)

(73) Assignee: Conception Et Developpement Michelin S.A., Givisiez (CH)

( * ) Notice: Subject to any disclaimer, the term of this patent is extended or adjusted under 35 U.S.C. 154(b) by 0 days.

(21) Appl. No.: 09/631,866

(22) Filed: Aug. 3, 2000

(30) Foreign Application Priority Data

Aug. 4, 1999 (FR) ..... 99 10173

(51) Int. Cl.[7] ..... H01R 4/24
(52) U.S. Cl. ..... 439/402; 439/417
(58) Field of Search ..... 439/402, 403, 439/404, 405, 417

(56) References Cited

U.S. PATENT DOCUMENTS 2,745,065 A 5/1956 Maher
4,472,216 A * 9/1984 Hogenhout et al. ..... 156/50
4,736,072 A 4/1988 Hvidsten
5,123,853 A 6/1992 Gilbert et al.
5,514,005 A 5/1996 Jaycox et al.
5,949,022 A * 9/1999 Park et al. ..... 174/77 R

FOREIGN PATENT DOCUMENTS

EP 0443331 8/1991

* cited by examiner

*Primary Examiner*—Tho D. Ta
*Assistant Examiner*—Phuongchi Nguyen
(74) *Attorney, Agent, or Firm*—Baker Botts L.L.P.

(57) ABSTRACT

A connector for three cables, each having two electric wires composed of a conductive core surrounded by an insulating sleeve. The connector includes an insulating block provided with as many separate holes as there are wires, the holes each receiving a nonstripped end of an electric wire that is inserted in the recess. The connector has two electrically conductive couplings, having as many terminal parts as electric wires to be connected, each of the terminal parts being shaped to break the insulating sleeve and then enter in conductive electric contact with the conductive core.

16 Claims, 9 Drawing Sheets

16
15
121
120
12H
33
33H
G
A
H
33L
32H
32
32L
31H
31
31L
120
12L
F
14
150
140
M.

ELECTRIC CONNECTOR USING ELEMENTS PENETRATING THE INSULATION

BACKGROUND OF INVENTION

The present invention relates to electric connectors. It notably concerns electric connectors intended to make connections to an electric bus.

The wire bundles of electric machines, land or other vehicles and the most varied equipment are becoming more and more complex. One very revealing example is passenger cars, in which the weight of loaded wiring has increased considerably in recent years. To reverse that trend, a new technology has evolved, that of installing an electric bus, using multiplexed electric signals making it possible to channel a large number of different signals on the same electric line and connecting the different equipment to that electric bus. An electric bus generally comes in the form of a cable with a pair of shielded twisted conductors having an insulation sleeve. Each electric apparatus is connected in parallel on said electric line. The connection sleeve. Each electric apparatus is connected in parallel on said electric line. The connection requires either cutting the electric line and making the electric connection, or using connectors of the type equipping computer cables.

These connectors are rather expensive, for they are designed to connect and disconnect electric cables and, in addition, they generally contain numerous parallel lines. Further, in the case of electrical engineering applications intended to be made in an industrial setting or in the case of applications to motor vehicles, trains or airplanes, the electric line must operate in a very harsh environment, and it is important to make sure not only of good immunity to electric parasites, but it is also necessary to make sure of perfect tightness of the connection.

SUMMARY OF THE INVENTION

The object of the present invention is therefore to propose an electric connector which is economical enough to make and which lends itself to simple use, making possible a very quick connection, while ensuring perfect electric conductivity of the lines connected to one another, good mechanical strength of the connection, excellent maintenance of the cables thus connected and good tightness of the electric connection.

The invention proposes a connector for electric wires having an electrically conductive core surrounded by an electrically insulating sleeve, said connector containing an electrically insulating block provided with at least two separate recesses, each intended to receive the nonstripped end of an electric wire that is inserted in said recess, said connector containing at least one electrically conductive coupling having as many terminal parts as electric wires to be connected, each coupling consisting essentially of a strip of electrically conductive material, said strip containing an appreciably flat center core, extended laterally by said terminal parts, said terminal parts also being appreciably flat and arranged generally perpendicular to the center core, said terminal parts being shaped to break said insulating sleeve and then enter in electric contact with said conductive core, when a relative displacement is produced between said end of the electric wire and said terminal part, in a direction generally perpendicular to said end of the electric wire, upon mechanical contact of the terminal part against the insulating sleeve of the wire and across the latter, said coupling connecting at least two wires inserted in at least two recesses.

The description which following presents a nonlimitative application of the invention for the connection of different electric apparatuses to an electric bus. It involves connecting an apparatus to an electric line. It therefore involves connecting the cable coming from the apparatus to the cable constituting the electric bus. For most of the connections to be made, the electric bus crosses the connection, for there are other electric apparatuses above and below the connecting point. This is why connectors are described which make possible the connection of at least three electric cables, each having at least two electric wires, and containing at least two couplings, since there are two parallel electric paths. Each coupling is provided with at least three terminal parts to connect a wire of each of the cables.

The invention will be better understood by consulting the following specification, which illustrates three embodiments of the invention with the attached drawings.

DESCRIPTION OF PREFERRED EMBODIMENTS

The invention is illustrated in its application to the connection of electric cables containing two electric wires, each having an electrically conductive core, surrounded by an electrically insulating sleeve. The conductive core is made of several strands formed in a conductive material such as copper. Very common electric cables are involved, notably for making the wire bundles of motor vehicles or electrical machines. However, the invention is not limited to the electric connection of such electric cables and, notably, is not limited to the connection of cables having two electric conductors.

Figure 1:
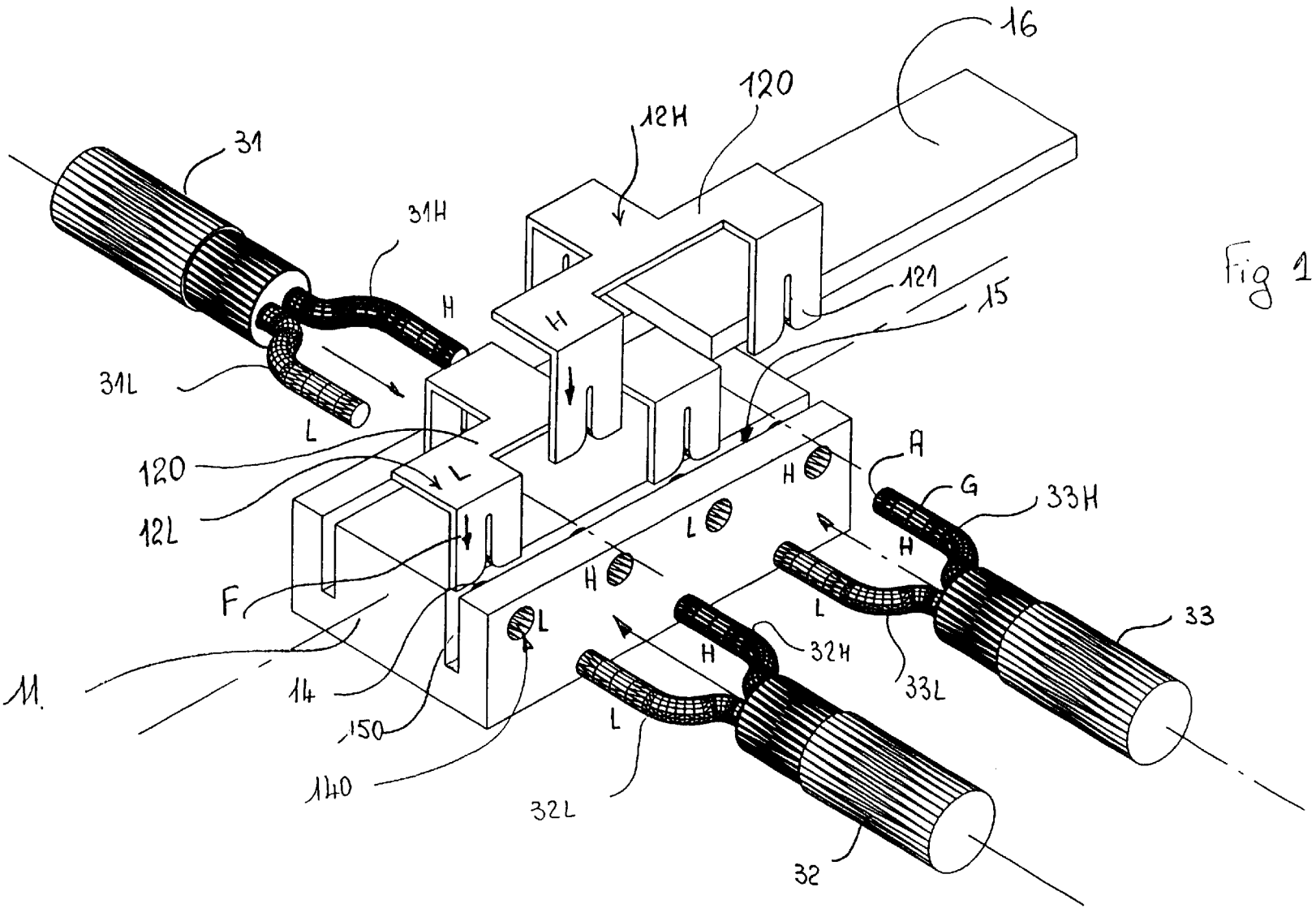
FIG. 1 is a partial exploded view of the connector according to a first working variant, depicting the electric cables ready to be connected.

FIG. 1 shows an electrically insulating block 11, constituting the structure carrying the electric connector according to the invention. The mechanical strength of the electric connector is due essentially to this insulating block. It is said insulating block which supports mechanically and at the same time immobilizes the elements securing the electric connection proper and the electric cables. The insulating block contains recesses 14, each intended to receive an electric wire containing the conductive core and the insulating sleeve. The recess 14 comprises, notably a hole 140 large enough to receive the nonstripped electric wire. The block 11 contains as many holes 140 as there are electric wires, that is, six in the example of use for the connection of three electric cables with two conductive wires each. Four of those holes 140 are provided on one of the lateral faces of the insulating block 11 and two of those holes 140 are provided on the opposite lateral face. On each side of the insulating block 11, a groove 15 traverses the block and crosses the holes 140 placed on one of the sides of the insulating block.

Three electric cables 31, 32 and 33 can also be seen. Each of those electric cables contains two conductive wires marked respectively by reference L and H added to the electric cable reference. Since it is a question of securing the electric connect between two-conductor cables, the connector contains two electric couplings 12L and 12H. Each of the couplings 12L and 12H (see coupling 12 in FIG. 2) is a part intended to be mounted on the insulating block. Said part contains a center core 120 made, for example, by means of a strip of an electrically conductive metal. The center core 120 is appreciably flat. Said center core 120 is extended laterally by terminal parts 121, which in turn are appreciably flat and arranged roughly at right angles to the center core 120. Each of these terminal parts 121 contains a slot 122 with rounded leading edges, calibrated to the size of the conductive cores of the electric cables it is necessary to connect. The terminal part 121 is intended to be mounted astride the wire, the latter being inserted between the rounded edges and driven into the slot 122 (see FIG. 2).

It has been seen that the recess 14 comprises a hole 140 intended to receive a nonstripped electric wire. In order to receive the terminal part 121, the recess also comprises a chamber 150 crossing the hole 140. The volume of the chamber 150 is adjusted to make possible a sufficient penetration of a terminal part 121. In the embodiment illustrated, on each side of said electrically insulating block 11, a groove 15 contains, in fact, several chambers 150. Let us note that each of the holes 140 is deeper than the distance lying between the farthest wall of the groove 15 and the outer face of the insulating block. Each of the chambers 150 (or grooves 15) crosses each of the holes 140, which makes it possible to insert the electric wire farther than the groove 15.

The electric connection is made as follows. First of all, each of the electric cables is prepared as usual in order to make electric connections. This consists of removing the head of the electric cable from the outer insulating sleeve and possibly from the sheathing, if the electric cable contains one. One then encounters electric cables, whose ends let the electric wires freely appear. The latter will not be stripped. They go beyond the outer insulating sleeve, both by the same length. The first stage of the electric connection consists of inserting each of the electric wires of each cable into the holes 140 with which the insulating block 11 is provided. The ends of the wires are inserted into the recesses 14 through the holes 140 up to the groove 15, in order to hold the wire well on the subsequent electric connection. More precisely, wire 31L and wire 31H of cable 31 are inserted into the recesses respectively marked L and H on one side of the insulating block (side not visible in FIG. 1), and then wires 32L and 32H of cable 32 are inserted into recesses 14 marked L and H on the other side of the insulating block, and so on.

Figure 2:
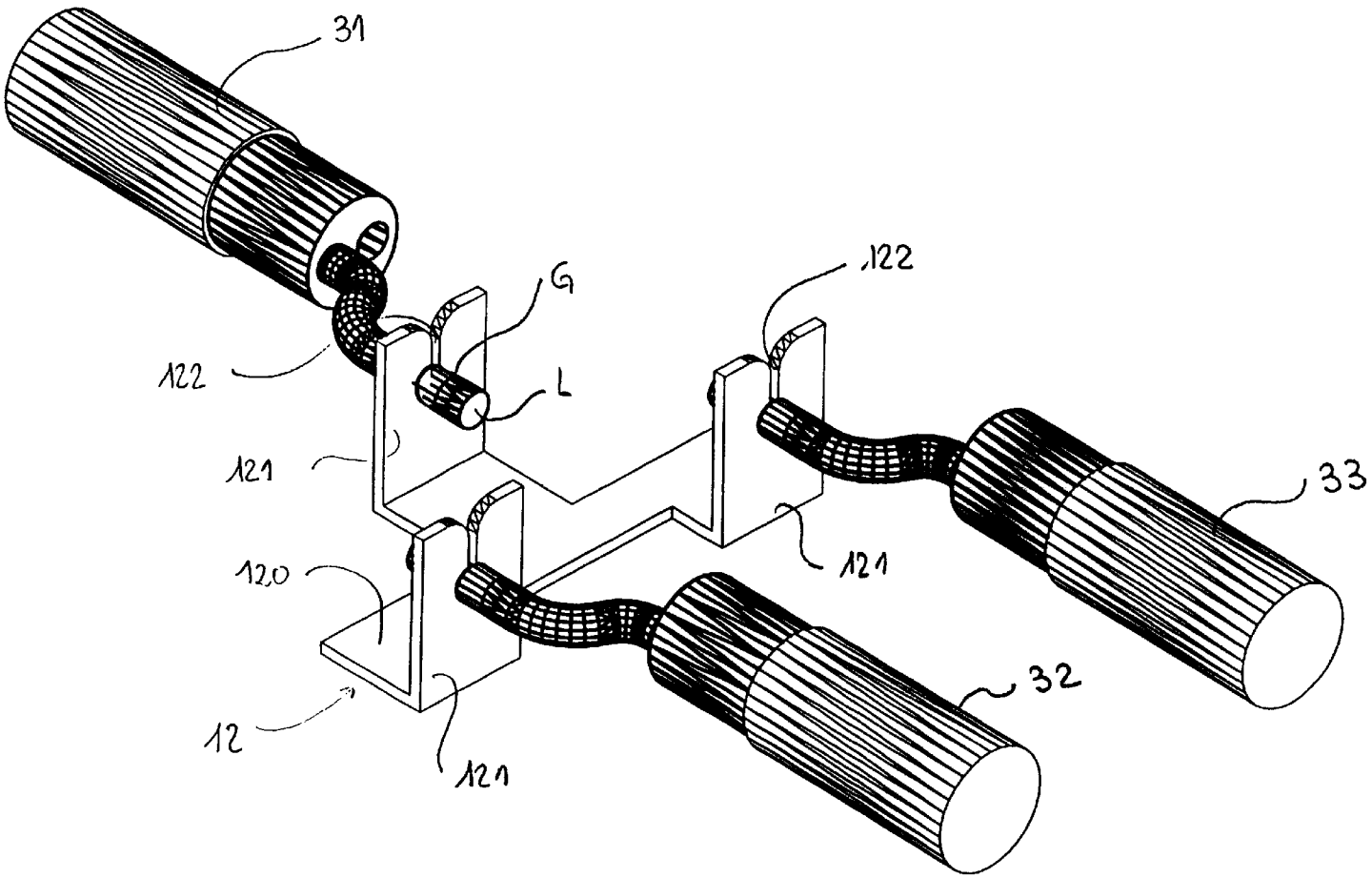
FIG. 2 is a detail illustrating the electric connection by means of said first connector.

The following stage in the electric connection is the mounting of the first of the electric couplings 12L. The latter is presented above the insulating block 11 so that its terminal parts 121 are opposite the grooves 15. Furthermore, the terminal parts 121 are positioned with each slot 122 straddling one of the electric wires of each of the electric cables to be connected in parallel, namely, the electric wires marked L. This drives this first coupling 12L in the direction of arrow F (FIG. 1). By doing so, the terminal parts 121 grip each of the electric wires, as illustrated in FIG. 2. The insulation of the electric wires is broken by the edges of the slots 122 of said terminal parts, so that the material of the coupling 12L comes in contact with the electric core A of each of the electric wires. It can be observed that the wires have been inserted into the recesses of the insulating block parallel to a first direction, and then the penetration of the coupling produces a relative displacement between wire end and terminal part parallel to a second direction, which is roughly perpendicular to the first.

Once that operation is performed, each of the terminal parts of the coupling 12L firmly immobilizes one of the electric wires of each cable, the parallel electric connection of which has to be secured. In the course of this stage of insertion of the coupling, the electric wire is locked at the same time on the insulating block, thereby ensuring good mechanical resistance of the electric wire on the insulating block, as well as the electric connection of three wires in parallel.

Figure 3:
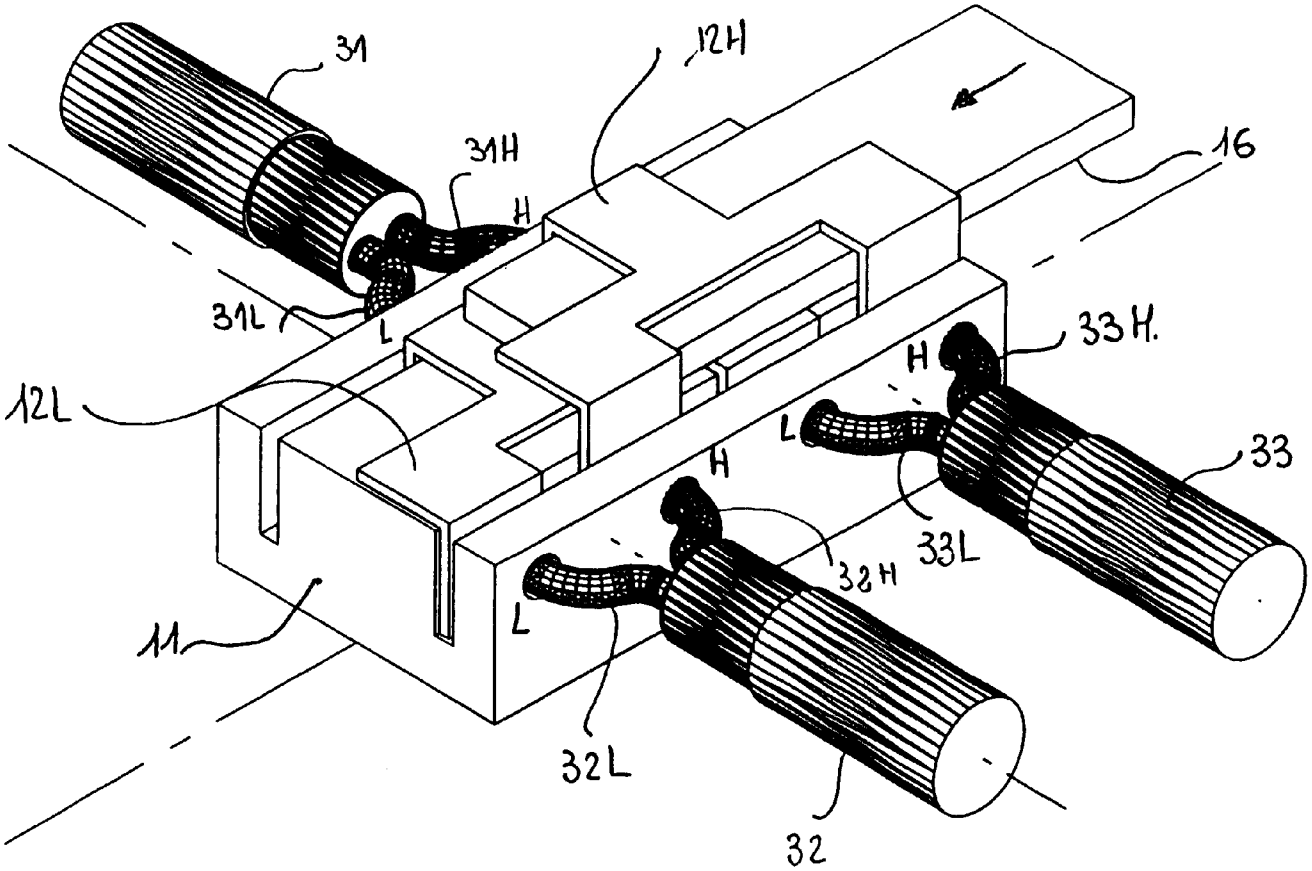
FIG. 3 shows the electric connector of that first variant after making the electric connection.

The following stage consists of superposing on the first coupling 12L an electrically insulating inset 16 (see FIGS. 1 and 3). Then a second coupling 12H is inserted in a manner similar to what was done for the first coupling 12L, but so that each of its terminal parts 121 overlaps the second conductive wire of each of the electric cables. It will be noted that the terminal parts 121 of a coupling (for example, coupling 12L) are therefore staggered in relation to the terminal parts 121 of the other couplings (here coupling 12H). The couplings are all superposed on the same side of the insulating block, an electrically insulating inset 16 separating two superposed couplings 12L, 12H. The configuration of FIG. 3 is then arrived at, where it can be seen that each of the three electric cables is now perfectly joined to the insulating block both mechanically and electrically by two parallel electric connection paths.

The following stage consists of perfecting the retention of the cables on the insulating block and of sealing the connection. A casing 17 (FIG. 4) is used, essentially containing two shells 171 and 172. Each of these shells contains a lip 173 and 174, respectively. The lips 173, 174 are superposed by bringing the two shells 171 and 172 in contact with each other. At least one of the shells (both here) contains as many recesses 175, 176 as there are cables. In the working example described here, there are three recesses 175 and 176 respectively, having the shape of half-cylinders, which make it possible to accommodate the cable heads. Furthermore, the shells of the casing and/or insulating block 11 contain locking studs or lugs (not represented), so as to be able to immobilize the two shells of the casing together and in relation to the insulating block on mounting. The two shells 171 and 172 are brought together and around the insulating block 11 until they are locked to one another by snapping (not represented).

Figure 5:
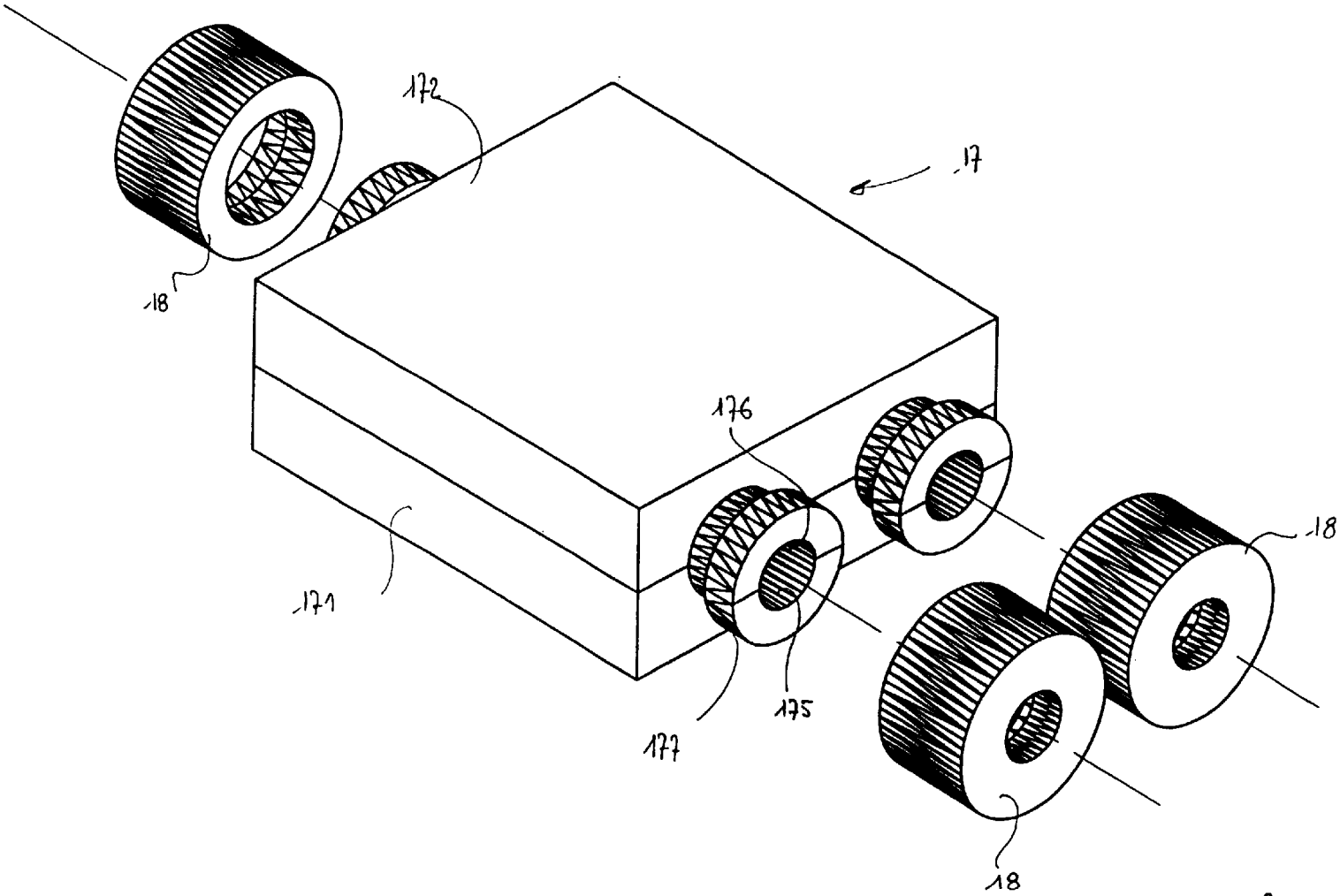
FIG. 5 illustrates the electric connector of the first variant in a final phase of assembly.

The final phase of mounting consists of sliding the sealing caps 18 (FIG. 5) which will have been previously attached on each of the cables. In order to receive these caps 18, the recesses 175, 176 end on the outer side of the casing in flanges 177 on which the caps 18 are mounted, so as to complete the closing of the casing. Let us note that locking of the casing in closing position can also simply be accomplished by the mounting of such caps. Finally, let us note that, instead of a two-shell casing, a single cap covering the block on the side of the couplings can be used, the block remaining visible on the opposite side.

Figure 6:
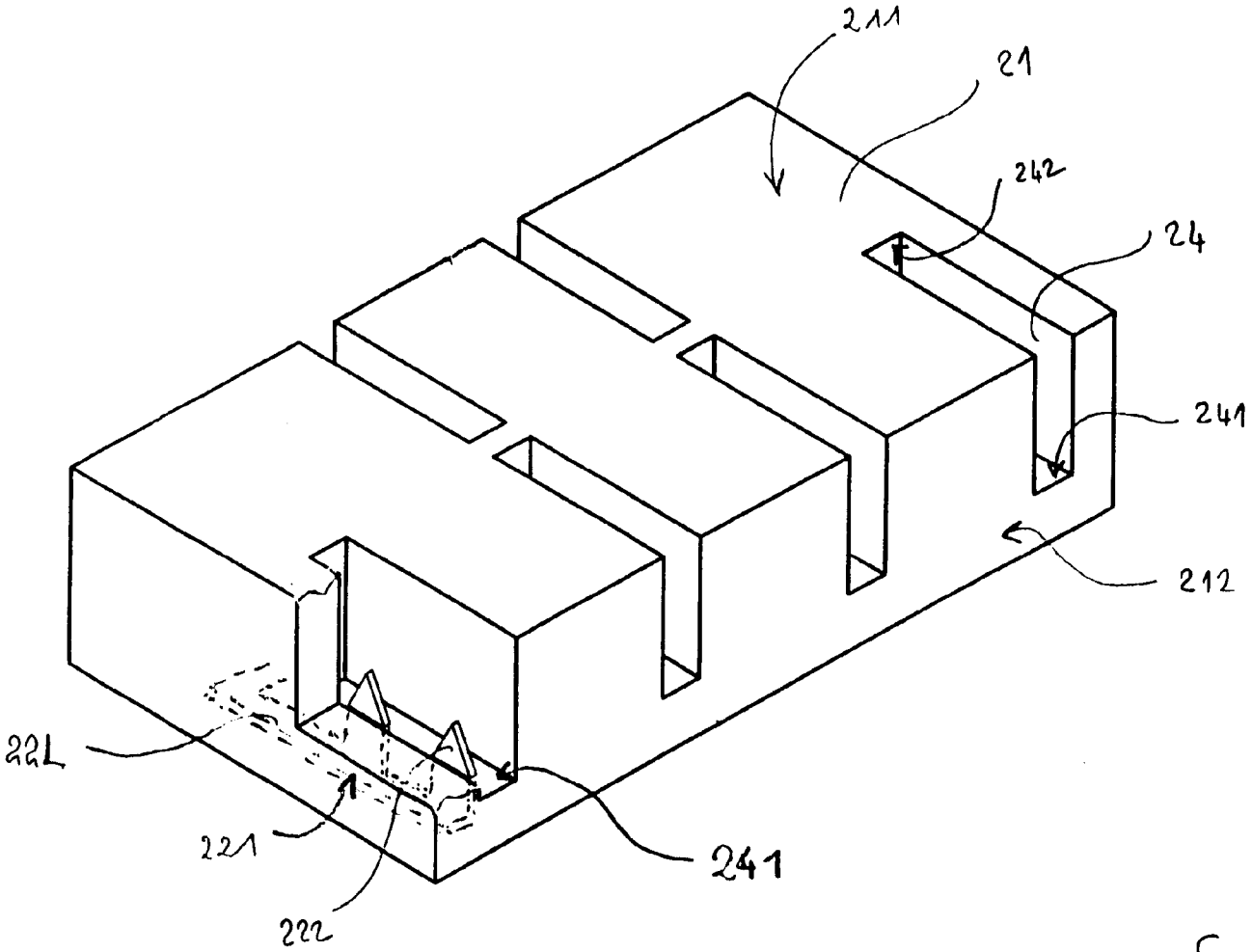
FIG. 6 is a partial view of a second variant of an electric connector according to the present invention.
Figure 7:
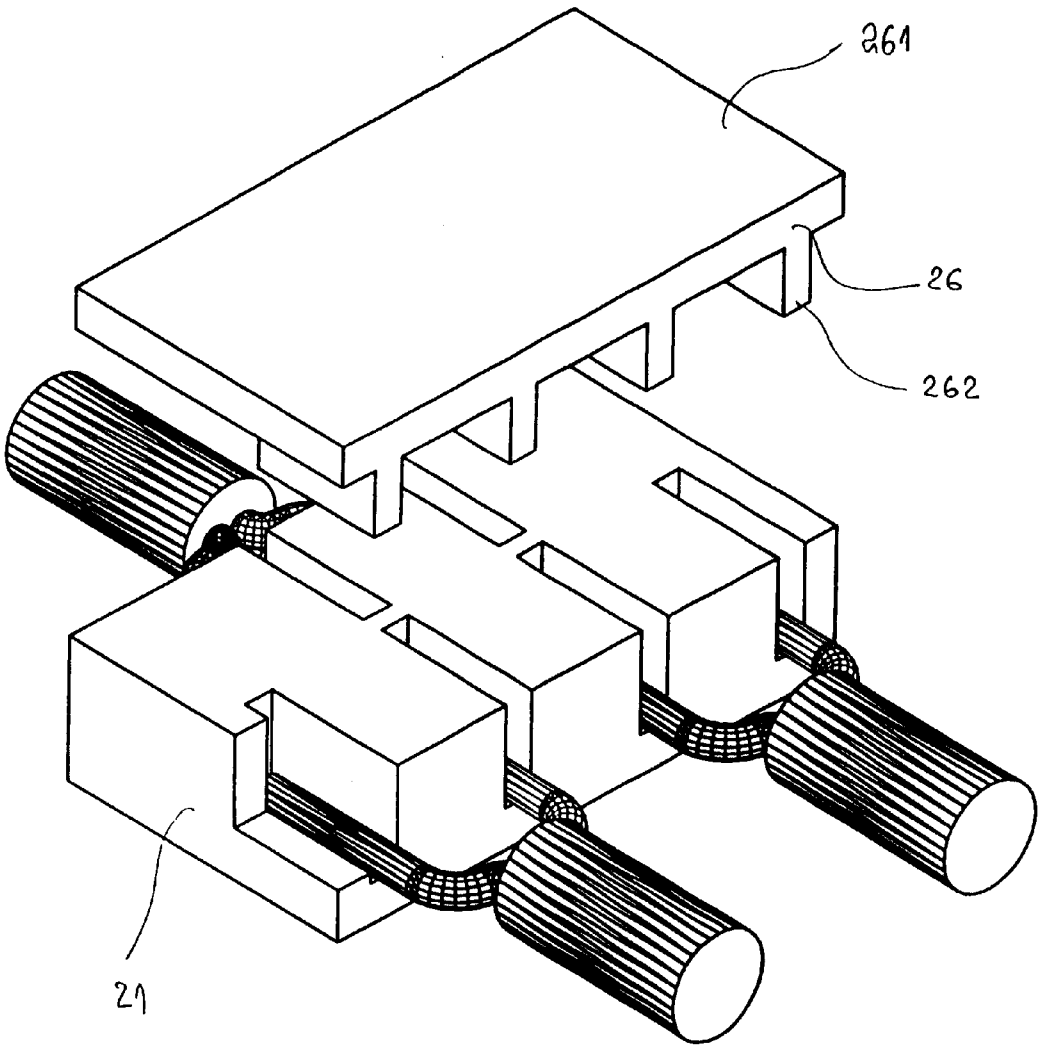
FIG. 7 illustrates a phase of assembly of an electric connector according to a second variant.
Figure 8:
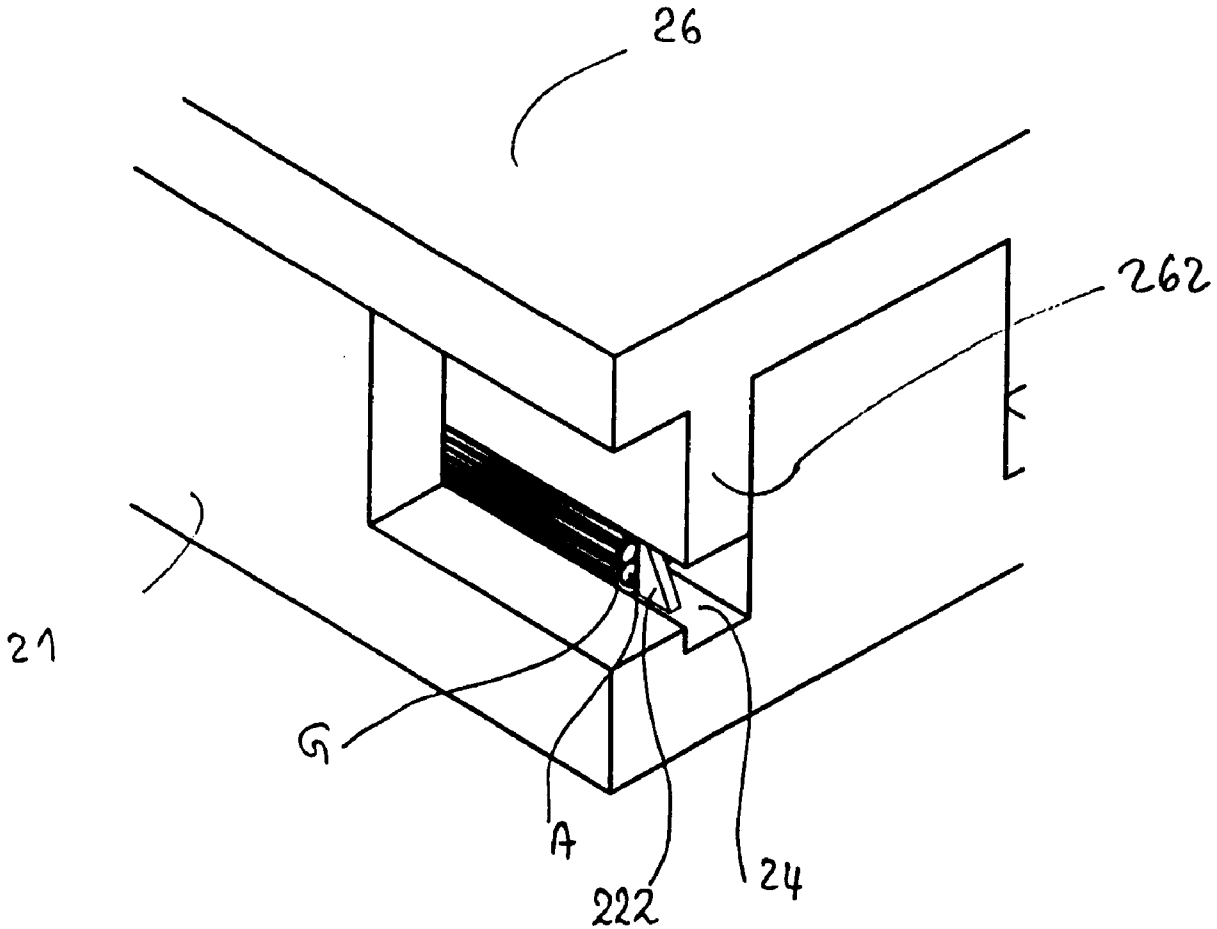
FIG. 8 is a detail illustrating the electric connection in the second variant.

The working variant illustrated in FIGS. 6, 7 and 8 is essentially distinguished in that the electric couplings are embedded in the insulating block and in that an independent connector is used, entering into contact simultaneously with the assemblage of electric wires. The other aspects of the invention can be similar to what was described for the first embodiment. This second example introduces the concept of independent presser of said coupling or couplings to produce the said relative displacement, so as to create said electric connection between each of said electric wire ends and said terminal part of the electric coupling. In a very advantageous variant, because it reduces the total number of parts of the connector, said presser is a single connecting element, made of an electrically insulating material. This single connecting element could, of course, secure the connection of two conducting wires in order to create a single electric line, but it is also suitable, as in the previous example, for application to the joining of electric apparatuses to an electric bus. Said single connecting element therefore makes possible also the connection of at least three electric cables, each having at least two parallel electric wires.

It can be seen especially in FIG. 6 that the insulating block 21 contains as many recesses 24 independent of one another as there are electric wires in the cables to be connected. Each of the recesses 24 opens up on two contiguous faces 211, 212 of said insulating block 21 and extends to bottom surfaces 241, 242 respectively opposite each of said contiguous faces of the block. Thanks to a partial exploded view, it can be seen that, on one 241 of said bottom surfaces (in fact, on one for each of the recesses 24), two spikes 222 appear (in fact, just one could suffice, but two ensure a better electric connection as well as better mechanical resistance), made of an electrically conductive material and rising from said bottom surface. In this embodiment, it is the terminal part 221 of a coupling 22L. Of course, two electric couplings are embedded in the insulating block 21 and are insulated from each other in order to secure a first electric connection between three of the six recesses and another electric connection among the other three.

In FIG. 7, a single connecting element 26 can be seen, made of an electrically nonconductive material, having a center support 261 to which are attached as many parallel depending fingers 262 as there are recesses, that is, as there are electric connections to be secured. Each of the fingers 262 extends perpendicular to said center support 261. The connecting element 26 is shaped so that its fingers can be inserted in each of the recesses 24.

The electric connection is made as follows. One begins first by positioning the electric cables inside recesses in the manner illustrated in FIG. 7. At that stage, each of the electric wires is placed on at least one spike 222. Then the electric connecting element 26 is presented above the insulating block 21 and each of those fingers 262 is inserted in the recesses 24. Due to the single connecting element 26, the relative displacement between the end of the electric wire and the terminal part of the coupling is produced, in a direction roughly perpendicular to said end of the electric wire. The relative displacement takes place on mechanical contact of the terminal part 221 by its spike 222 against the insulating sleeve G of the wire. Sufficient pressure is exerted for these spikes 222 to be able to break the insulating sleeve and come in contact with the conductive core A of each of the electric wires, the relative displacement continuing through the insulating sleeve G. In FIG. 8, an exploded view in the electric wire at the level of spike 222 illustrates the establishment of the electric connection. The final phase of the electric connection consists of mounting a casing of the type illustrated in the first embodiment. As a variant, one or more couplings could be used, like that described with the first example, embedded this time in an electrically insulating block, in combination with an independent presser made of electrically insulating material.

In the case of connection of shielded electric cables, immunity to parasites can be ensured by arranging for the shells of the electric casing to be made of a conductive material, for example, a thermoplastic casing rendered conductive by appropriate charges in order to make an electric connection between all the shieldings. In that case, after mounting of the electric cables and connection of the electric wires together by couplings, it is advisable to mount the electric shielding above the flanges of the shells of the casing.

Figure 9:
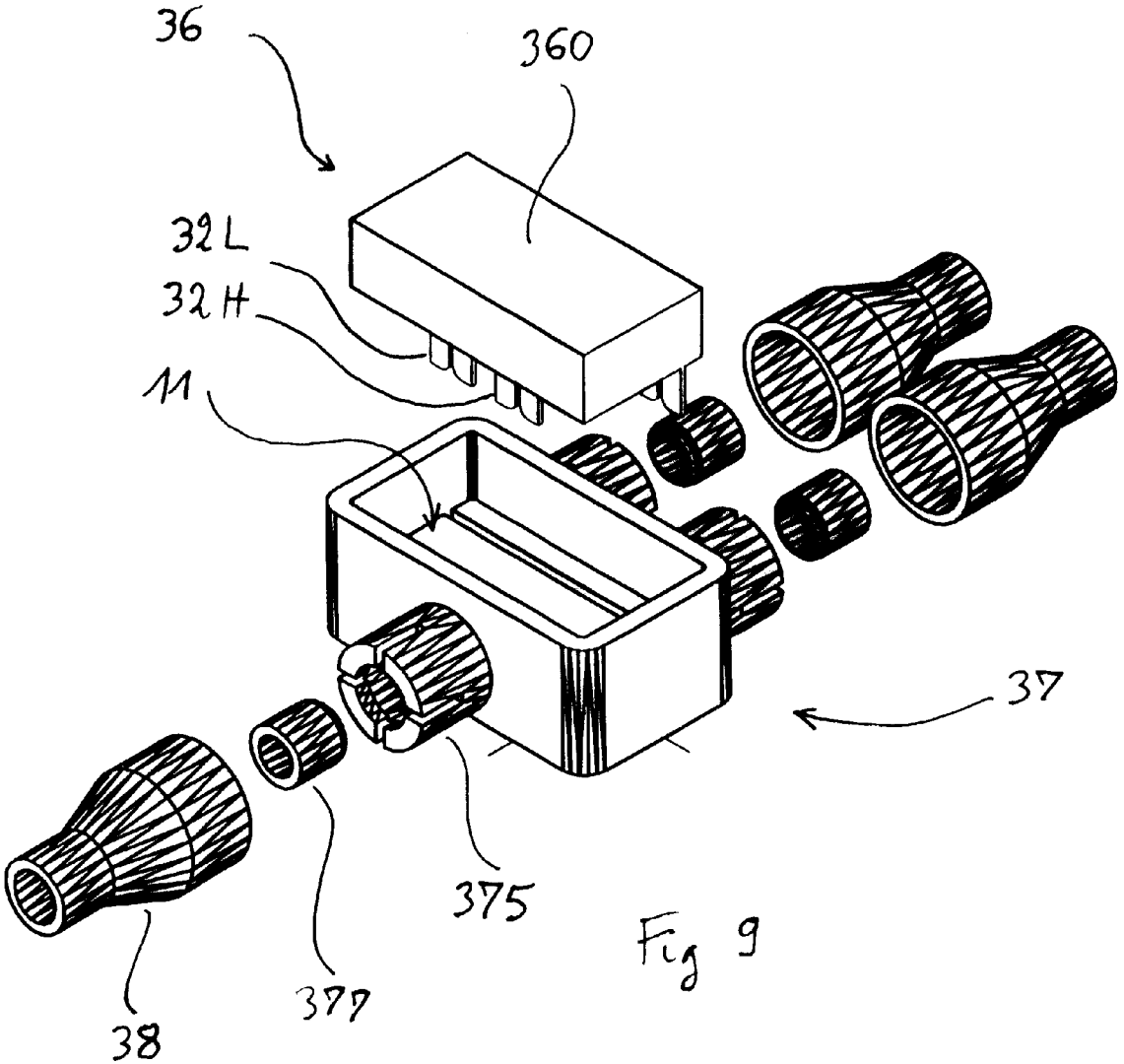
FIG. 9 is a partial exploded view of the electric connector according to a third variant.

FIG. 9 shows a connector according to a third embodiment, using an electrically insulating block in all respects comparable to the insulating block 11 described in FIG. 1. It is distinguished from the first embodiment by the connecting element 36. It consists of couplings 32L, 32H in all respects comparable to the couplings 12L and 12H described in FIGS. 1 and 2. The couplings 32L, 32H are embedded here in an electrically insulating base 360. The connecting element 36 is thus in one piece, the electric connection operation being more rapid.

The FIG. 9 also shows locking rings 377 (as many as there are cables or wires to be connected). These locking rings 377 are designed to be mounted on said wires or cables and can be locked on said guide. They are particularly well suited to receiving the metal braiding of a shielded cable, which is turned outside said locking rings 377. This makes it possible to guarantee the electromagnetic compatibility of the connector. For this purpose, the casing 37 contains a metal plating, for example, solely on its inner surfaces, intended to secure electric conduction between the guides. This type of connection for shieldings, by metal plating of the casing, can be easily made in a comparable manner on casing 17.

Figure 4:
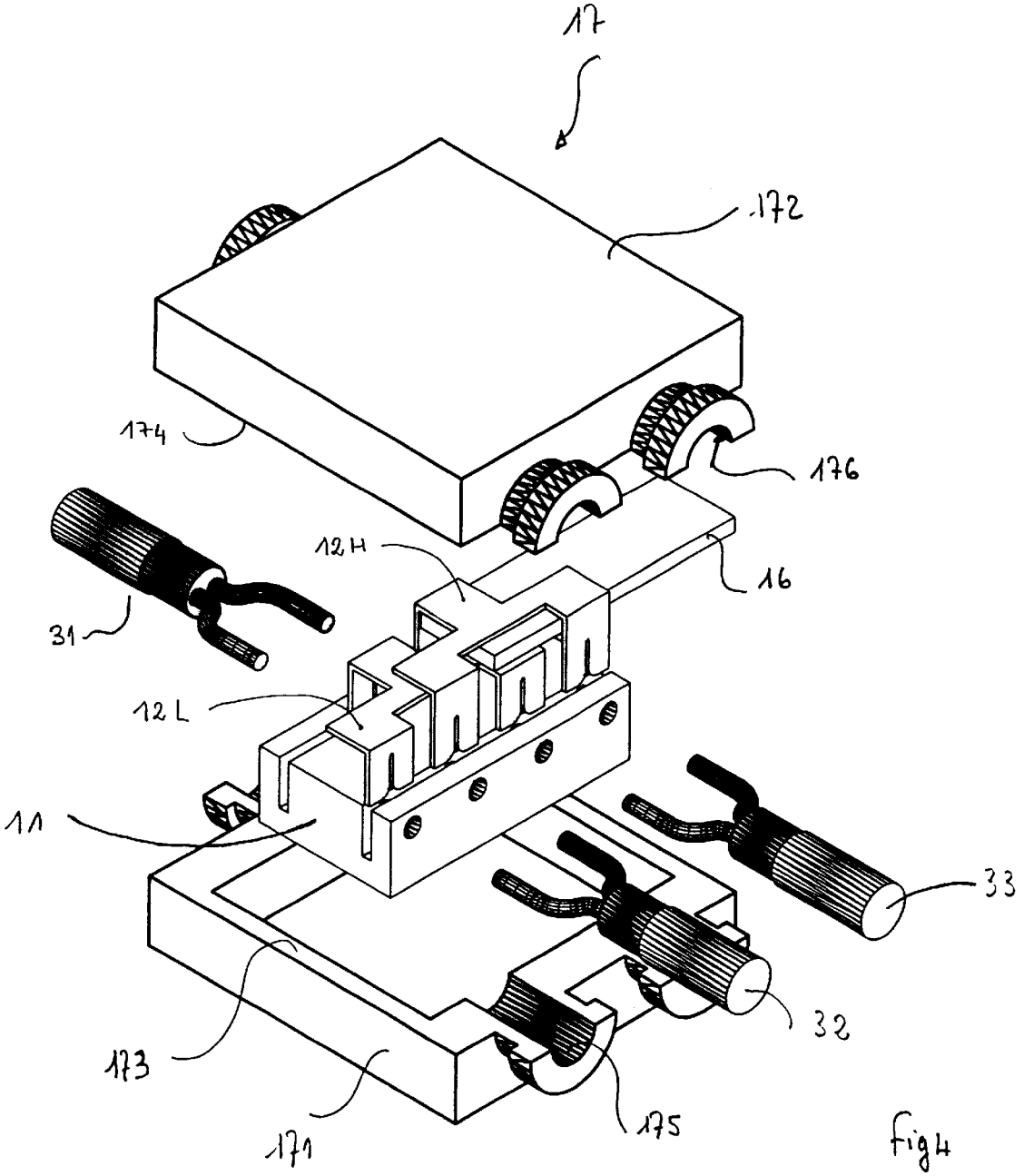
FIG. 4 is an exploded view of the electric connector of the first variant, showing the it complementary elements.

Let us also point out that the insulating block 21 and connecting element 26 can be mounted inside a casing 17 containing two complementary shells 171 and 172, as illustrated in FIG. 4, or in the casing 37, and that the insulating block 11 and connecting element 36 can also be mounted inside a casing 17.

The connector proposed in the present invention lends itself to mass production at very low cost, for example, by injection of thermoplastic material for the insulating block, as well as for the intermediate insulator 16 and for the shells of the casing, and by stamping for the couplings. It lends itself to rapid mounting on machine or vehicle assembly lines. It does not require any welding or tightening of screws. With the choice of appropriate materials and choice of correct dimensions, the expert will understand that the connector is suitable for ensuring at the same time good mechanical resistance of the electric connection and of the cables joined by the connector. In addition, this connector requires only a few simple motions to secure the electric connection on assembly.

I claim:

1. A connector for connecting corresponding electric wires of different cables in parallel circuits, each such wire having an electrically conductive core surrounded by an electrically insulating sleeve and terminating in a pre-cut end from which the insulation sleeve has not been stripped, said connector including an electrically insulating block provided with at least two separate recesses, each being of limited length to receive a nonstripped pre-cut end of an electric wire that is inserted in said recess, said connector further including at least one electrically conductive coupling having as many terminal parts as electric wires to be connected, each coupling including a strip of electrically conductive material, said strip having an appreciably flat center core, extended laterally by said terminal pats, said terminal parts also being appreciably flat and arranged generally perpendicular to the center core, said terminal parts being shaped to break said insulating sleeve and then enter in electric contact with said conductive core, when a relative displacement is produced between said end of the electric wire and said terminal part, in a direction generally perpendicular to said end of the electric wire, upon mechanical contact of the terminal part against the insulating sleeve of the wire and across the latter, said coupling connecting at least two wires inserted in at least two recesses, and in which the conductive coupling has at least three terminals to connect one conductive core to two corresponding conductive cores of parallel circuits.

2. A connector according to claim 1 in which the said terminal parts each contain a slot calibrated to said conductive core of the wire.

3. A connector according to claim 1, in which each of the recesses comprises a hole receiving and supporting an electric wire, each of the couplings being a part mounted on the said insulating block, and which is inserted on said insulating block after engagement of the wires in their hole, thus producing the said relative displacement between said end of the electric wire and terminal part, and in which each of the recesses further comprises a chamber crossing said hole, said chamber receiving a terminal part of a coupling.

4. A connector according to claim 3, in which a groove connecting the chambers crosses all the holes arranged on the same side of said insulating block, in which the terminal parts of a coupling are staggered in relation to the terminal parts of the other couplings, and in which the couplings are all superposed on one another on the same side of the insulating block, an electrically insulating inset separating two superposed couplings.

5. A connector according to claim 3, in which a groove connecting the chambers crosses all the holes arranged on the same side of said insulating block, in which the terminal parts of a coupling are staggered in relation to the terminal parts of the other couplings, and in which the couplings are all superposed on one another on the same side of the insulating block, and in which the couplings are embedded in an electrically insulating base.

6. A connector according to claim 1, including a casing having a shell and a complementary cap that locks on the shell, the shell having as many sheaths as there are cables or wires, forming a guide for receiving said cables or wires.

7. A connector according to claim 6, in which said guides end on the outer side of the casing in a flange and contain sealing caps designed to be attached on each of the wires or cables and positioned on said flanges.

8. A connector according to claim 6, having as many locking rings as there are cables or wires to be mounted on said wires or cables and lockable on said guide.

9. A connector according to claim 1, including a casing having two complementary shells that lock together, the lips of at least one of said shells containing recesses forming guides for receiving said cables or wires, the said shells encasing said block and said couplings.

10. A connector according to claim 9, in which said guides end on the outer side of the casing in a flange and contain seating caps designed to be attached on each of the wires or cables and positioned on said flanges.

11. A connector according to claim 9, having as many locking rings as there are cables or wires to be mounted on said wires or cables and lockable on said guide.

12. A connector according to claim 9, in which predetermined guides are electrically connected.

13. A connector according to claim 1, including a presser independent of said coupling or couplings, for producing said relative displacement, in order to create the said electric connection between each of said ends of the electric wire and said terminal part of the electric coupling.

14. A connector according to claim 13, making possible the connection of at least three electric cables, each having at least two electric wires, in which said presser is a single connecting element made of electrically insulating material.

15. A connector according to claim 13, in which each of the recesses opens up on two contiguous faces of said block and extends to bottom surfaces respectively opposite each of said contiguous faces of the block, and in which each of the couplings is embedded in said insulating block and each terminal part has at least one spike extending out of one of said bottom surfaces.

16. A connector according to claim 15, containing a single connecting element of electrically nonconductive material, by means of which said relative displacement is produced, the connecting element comprising a center support, on which are mounted as many parallel fingers as there are recesses, said fingers extending perpendicular to said center support, the connecting element being shaped so that its fingers will be inserted in each of the recesses after engagement of the said wire ends in the recesses opposite the spikes, so that the fingers drive said wire ends against the spikes.

* * * * *

UNITED STATES PATENT AND TRADEMARK OFFICE

CERTIFICATE OF CORRECTION

PATENT NO. : 6,402,541 B1
DATED : June 11, 2002
INVENTOR(S) : Patrick Mindeau

It is certified that error appears in the above-identified patent and that said Letters Patent is hereby corrected as shown below:

Title page,
Item [56], References Cited, OTHER PUBLICATIONS, insert -- Patent Abstracts of Japan, Vol. 1998, No. 10, 8/31/98, JP 10 125 363 (Nichefu Co. Ltd.) 5/15/98. --
Item [57], ABSTRACT,
Line 9, "in" should read -- into --
Item [73], Assignee, "Developpement" should read -- Développement --

Column 1,
Lines 21-23, "The connection sleeve. Each electric apparatus is connected in parallel on said electric line." should be deleted Column 2,
Line 1, "following" should read -- follows --
Line 29, "it" should be deleted Column 3,
Line 12, "connect" should read -- connection --

Column 5,
Line 7, "independent" should read -- an independent --

Column 7,
Line 6, "pats." should read -- parts. --

Column 8,
Line 15, "seating" should read -- sealing --

Signed and Sealed this

Eighteenth Day of February, 2003

JAMES E. ROGAN
*Director of the United States Patent and Trademark Office*